US008016646B1

(12) United States Patent
Bailey et al.

(10) Patent No.: US 8,016,646 B1
(45) Date of Patent: Sep. 13, 2011

(54) SAW BLADE SHARPENING ASSEMBLY

(76) Inventors: Kenneth L. Bailey, Jacksonville, NC (US); Beverly J. Bailey, Jacksonville, NC (US)

( * ) Notice: Subject to any disclaimer, the term of this patent is extended or adjusted under 35 U.S.C. 154(b) by 486 days.

(21) Appl. No.: 12/343,410

(22) Filed: Dec. 23, 2008

(51) Int. Cl.
*B24B 7/00* (2006.01)

(52) U.S. Cl. ..... 451/224; 451/283; 451/282; 451/213; 451/214; 76/48; 76/82

(58) Field of Classification Search ..... 451/283, 451/282, 213, 214, 224; 76/41, 48, 85, 89; 83/581
See application file for complete search history.

(56) References Cited

U.S. PATENT DOCUMENTS 2,012,513 A * 8/1935 Maze ..... 76/82
2,841,926 A * 7/1958 Lebus ..... 451/65
3,332,173 A * 7/1967 McMaster et al. ..... 451/282
3,334,446 A * 8/1967 Jager ..... 451/282
3,376,671 A * 4/1968 Wolter ..... 451/67
3,755,971 A * 9/1973 Garcia ..... 451/224
4,050,194 A * 9/1977 Rice ..... 451/282
4,450,653 A * 5/1984 Fletcher ..... 451/552
5,582,088 A * 12/1996 Harter ..... 83/468.4
5,711,516 A * 1/1998 Pan ..... 271/3.14
6,123,611 A * 9/2000 Lawrence, Jr. ..... 451/361
6,475,074 B2 * 11/2002 Blanton ..... 451/224
6,945,150 B2 * 9/2005 Chang ..... 83/435.12
7,555,976 B2 * 7/2009 Logan et al. ..... 83/471
7,854,187 B2 * 12/2010 Liu et al. ..... 83/471.3
2005/0092155 A1 * 5/2005 Phillips et al. ..... 83/581
2005/0172773 A1 * 8/2005 Ku et al. ..... 83/438
2005/0193865 A1 * 9/2005 Letendre ..... 76/48
2007/0034066 A1 * 2/2007 Garcia et al. ..... 83/581
2007/0157784 A1 * 7/2007 Gass et al. ..... 83/581
2008/0105089 A1 * 5/2008 Letendre ..... 76/48

* cited by examiner

*Primary Examiner* — George Nguyen
(74) *Attorney, Agent, or Firm* — Tung & Associates

(57) ABSTRACT

A saw blade sharpening assembly includes a sharpening disk, a blade support panel disposed generally adjacent to the sharpening disk and a generally sloped blade support base carried by the blade support panel.

12 Claims, 6 Drawing Sheets

SAW BLADE SHARPENING ASSEMBLY

FIELD OF THE INVENTION

The present disclosure relates to apparatus for sharpening saw blades. More particularly, the present disclosure relates to a saw blade sharpening assembly which is suitable for sharpening circular or table saw blades.

BACKGROUND OF THE INVENTION

Circular saws typically include a circular blade having multiple carbide-tipped saw teeth. As it is rotated typically by an electric motor, the blade is used to cut wood or other materials. After prolonged use, the teeth of the blade may become dull. This may require replacement of the blade to maintain the cutting efficiency of the saw.

Therefore, a saw blade sharpening assembly is needed which can be used to sharpen the saw teeth of a circular or table saw.

SUMMARY OF THE INVENTION

The present disclosure is generally directed to a saw blade sharpening assembly. An illustrative embodiment of the saw blade sharpening assembly includes a sharpening disk, a blade support panel disposed generally adjacent to the sharpening disk and a generally sloped blade support base carried by the blade support panel.

BRIEF DESCRIPTION OF THE DRAWINGS

The disclosure will now be made, by way of example, with reference to the accompanying drawings, in which.

DETAILED DESCRIPTION OF THE PREFERRED EMBODIMENT

Figure 1:
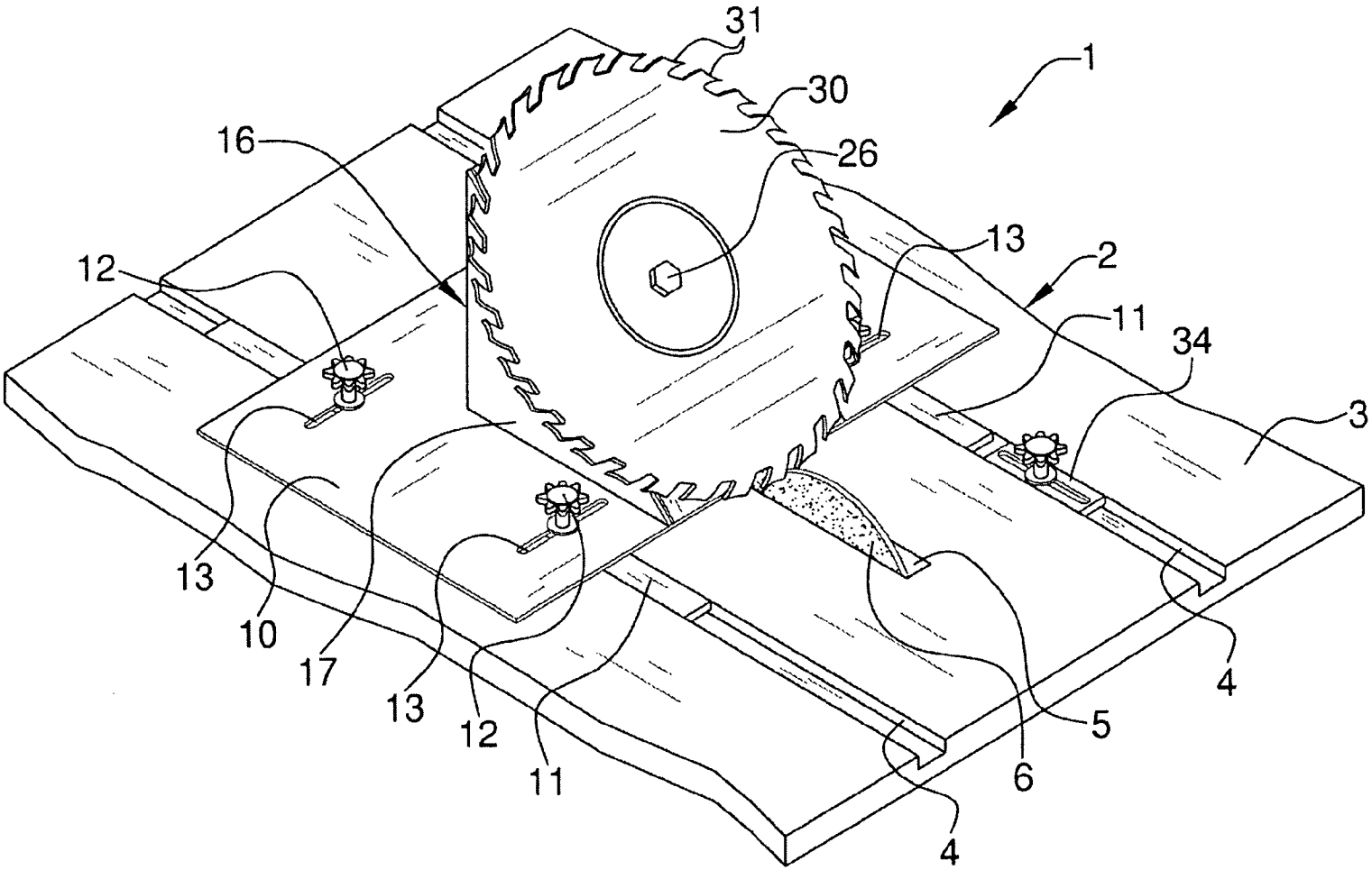
FIG. 1 is a perspective view of an illustrative embodiment of the saw blade sharpening assembly in the sharpening of a circular saw blade.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the invention and are not intended to limit the scope of the invention which is defined by the claims. Furthermore, there is no intention to be bound by any expressed or implied theory presented in the preceding technical field, background, brief summary or the following detailed description.

Referring to the drawings, an illustrative embodiment of the saw blade sharpening assembly, hereinafter assembly, is generally indicated by reference numeral 1. The assembly 1 may be used in conjunction with a table or circular saw 2 which may be conventional. The table/circular saw 2 may include a cutting surface 3. A pair of generally elongated, parallel, spaced-apart miter gauge slots 4 may extend through the cutting surface 3. A blade slot 5 extends through the cutting surface 3 between the miter gauge slots 4. A sharpening disk 6 is attached to a saw motor (not illustrated) of the table saw 2 and extends through the blade slot 5 for purposes which will be hereinafter described.

Figure 2:
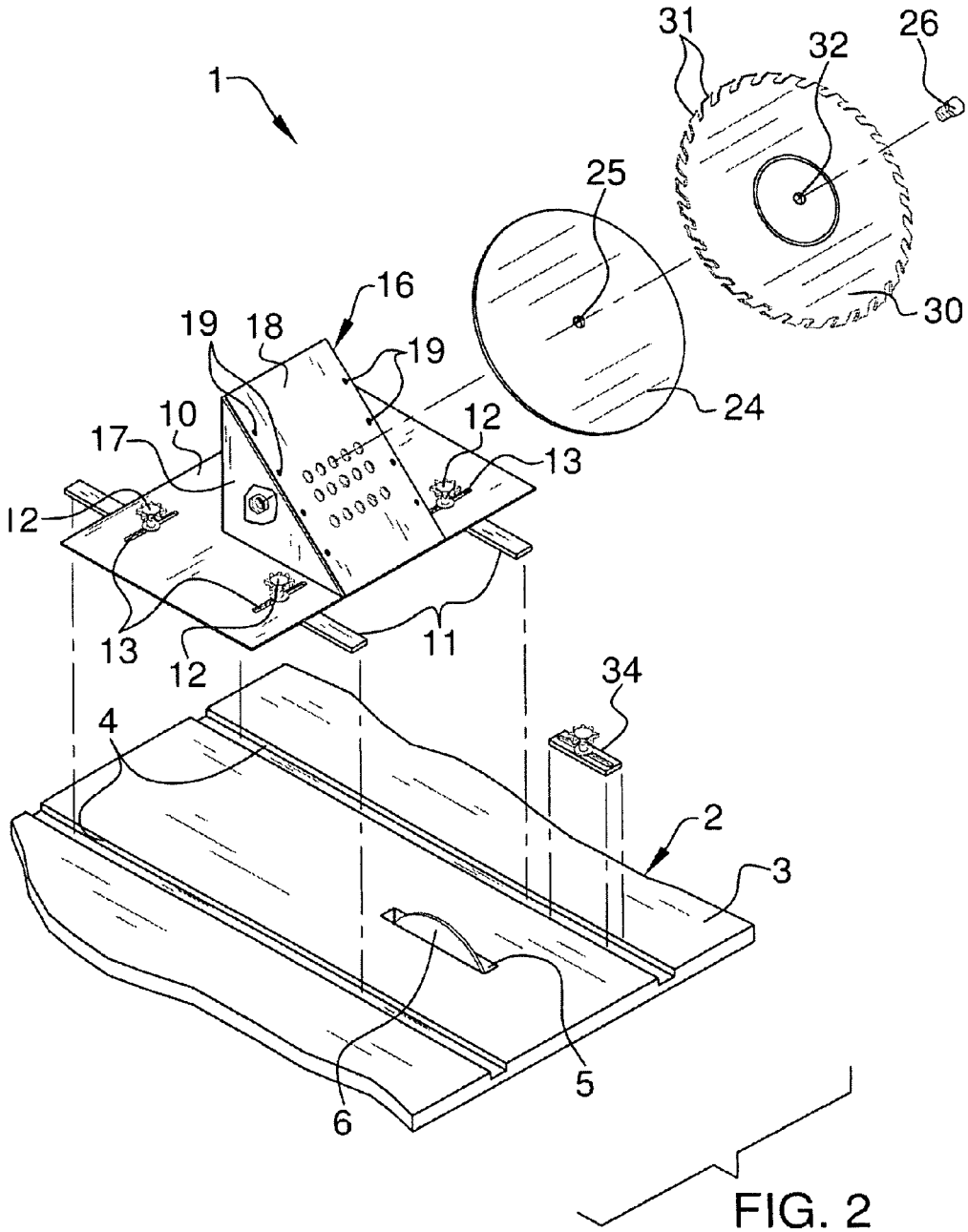
FIG. 2 is an exploded perspective view of an illustrative embodiment of the saw blade sharpening assembly, illustrating exemplary attachment of a circular saw blade to the assembly preparatory to sharpening of the circular saw blade.
Figure 3:
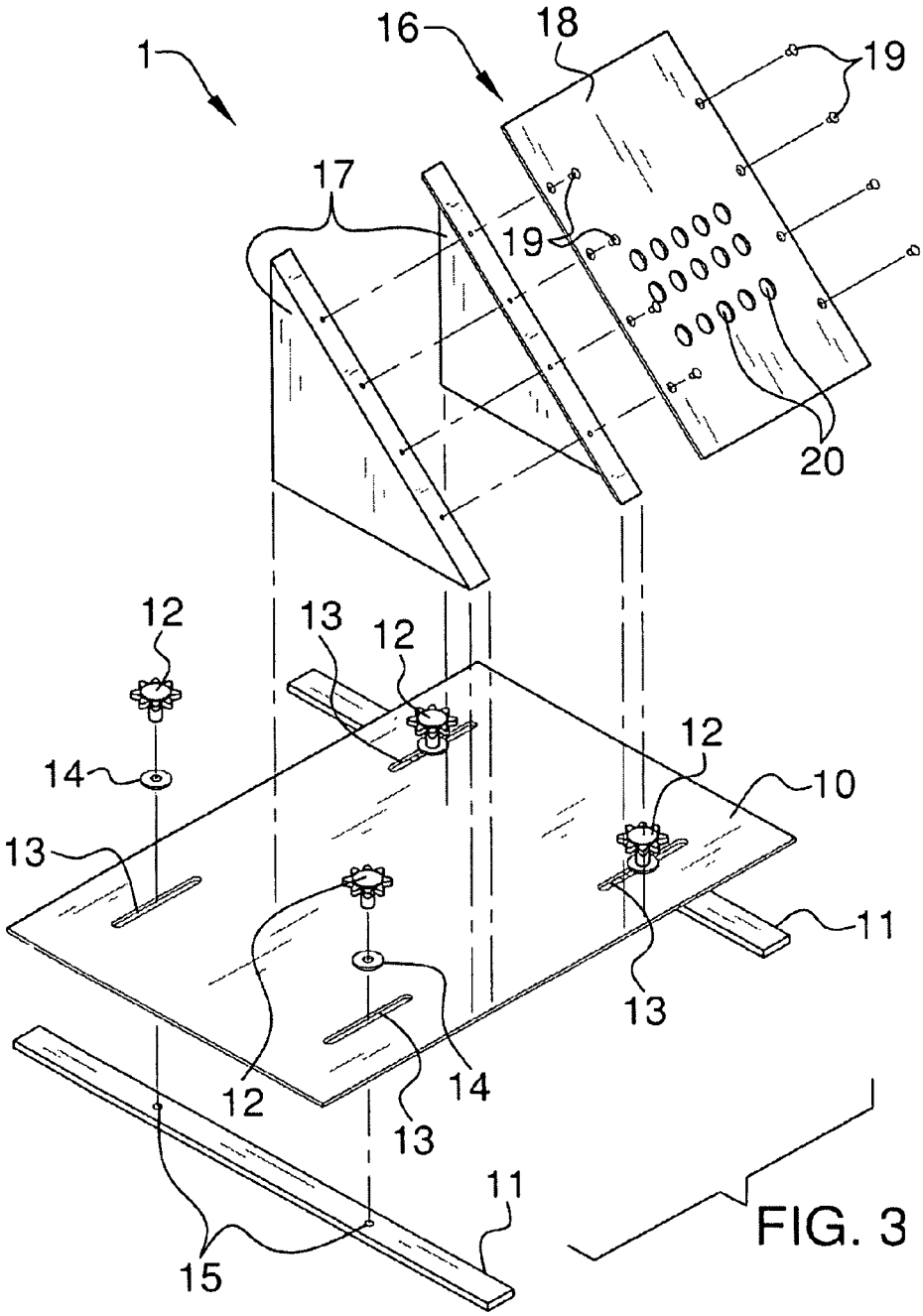
FIG. 3 is an exploded perspective view of an illustrative embodiment of the saw blade sharpening assembly.
Figure 4:
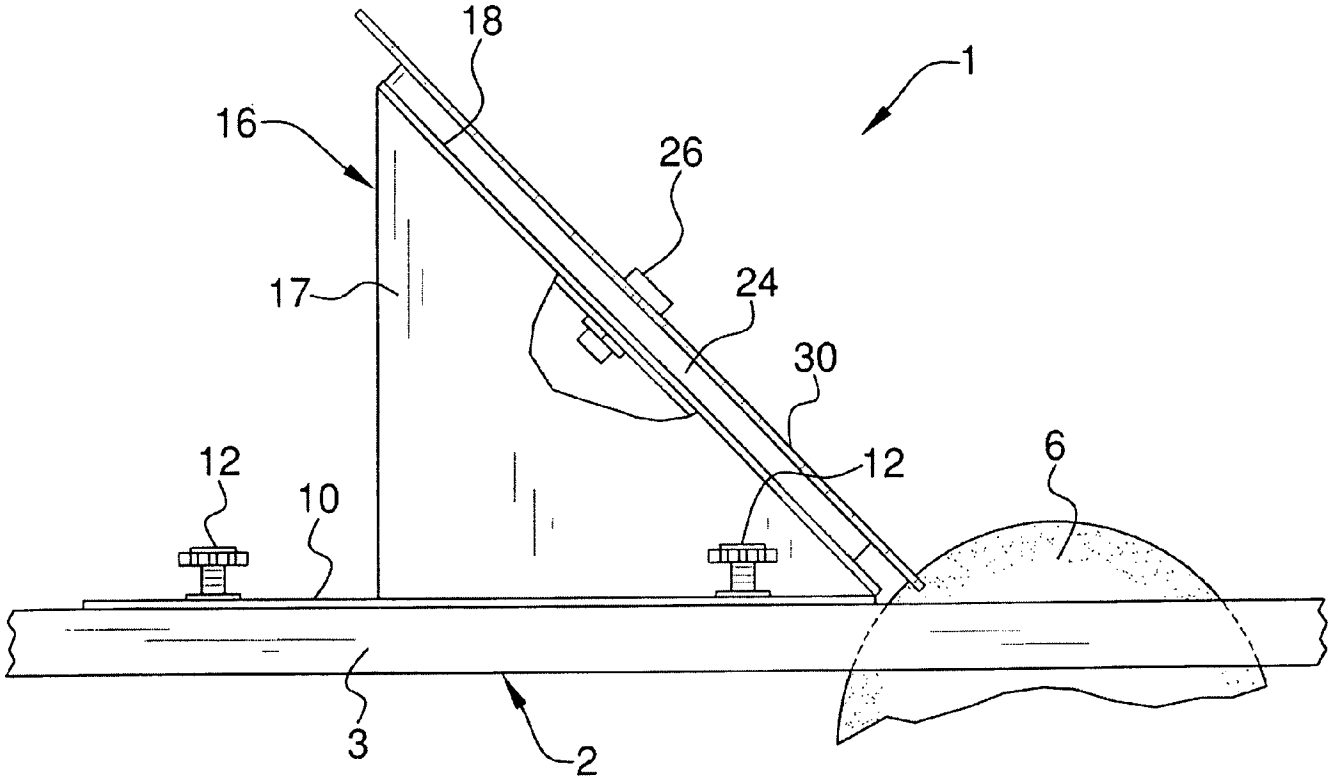
FIG. 4 is a sectional view of an illustrative embodiment of the saw blade sharpening assembly.
Figure 5:
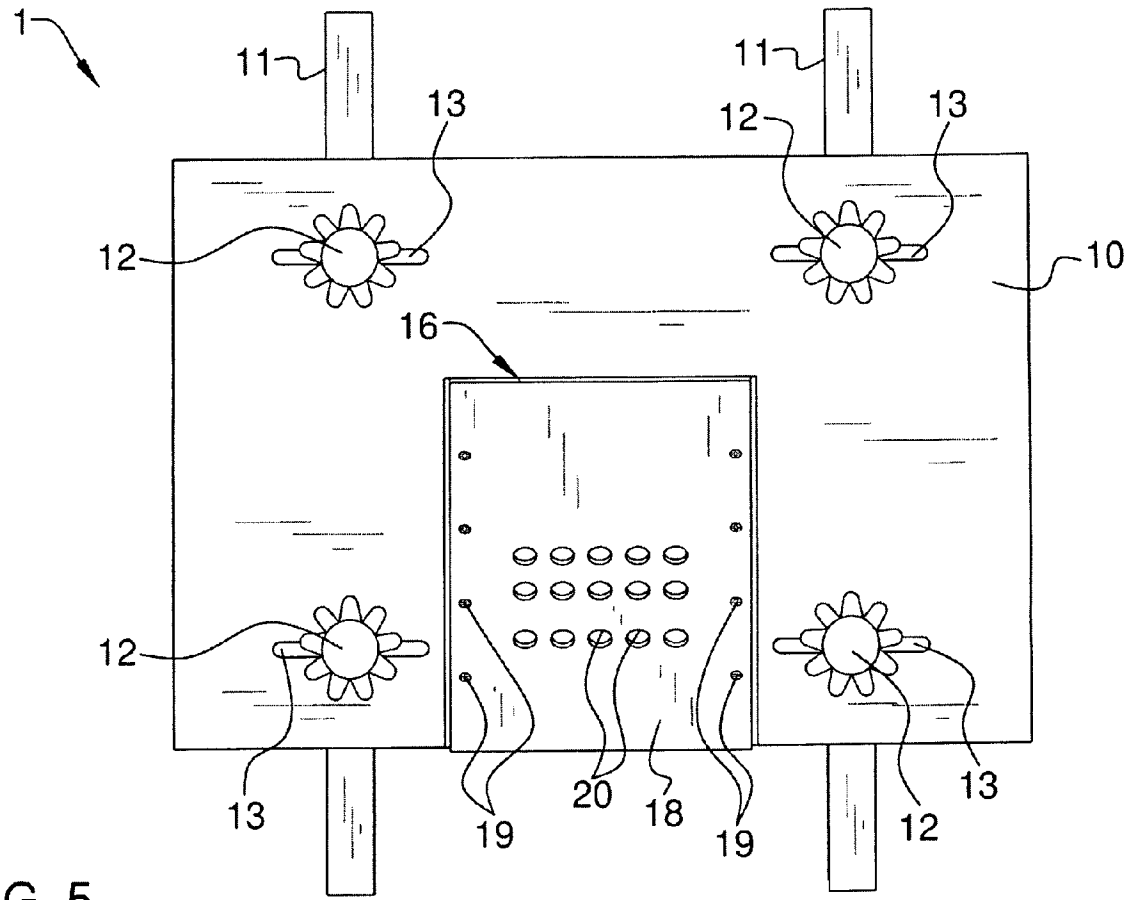
FIG. 5 is a top view of an illustrative embodiment of the saw blade sharpening assembly.
Figure 6:
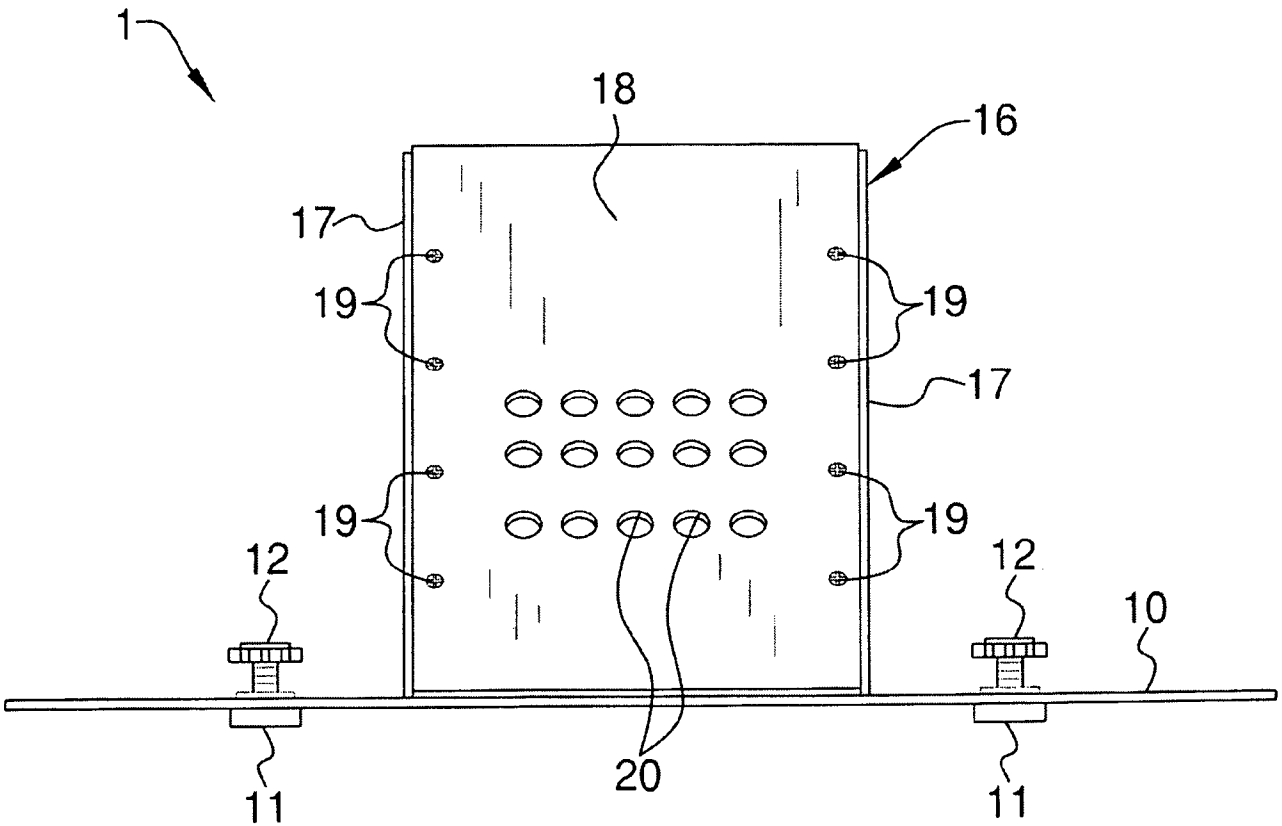
FIG. 6 is a front view of an illustrative embodiment of the saw blade sharpening assembly.

As shown in FIGS. 2 and 3, the assembly 1 may include a generally elongated, flat, rectangular blade support panel 10. A pair of generally elongated, parallel, spaced-apart guide rails 11 may be provided on a lower surface of the blade support panel 10. As shown in FIG. 2, the guide rails 11 may be adapted for insertion into the respective miter gauge slots 4 in the cutting surface 3 of the table saw 2. At least one stop 34 may be inserted and secured in at least one of the miter gauge slots 4 to limit the distance between the front edge of the blade support panel 10 and the edge of the sharpening disk 6.

In some embodiments, the blade support panel 10 may be laterally adjustable on the guide rails 11. Accordingly, as shown in FIG. 3, multiple, generally elongated, parallel, spaced-apart panel adjustment slots 13 may extend through the blade support panel 10. A pair of knob openings 15 may be provided in each guide rail 11 in registering relationship with respect to a corresponding pair of panel adjustment slots 13. A panel adjustment knob extends through each panel adjustment slot 13 and is threaded into the corresponding knob opening 15. A washer 14 may be interposed between each panel adjustment knob 12 and the blade support panel 10. Accordingly, each panel adjustment knob 12 may be partially unthreaded from the corresponding knob opening 15 to disengage an upper surface of the blade support panel 10 and facilitate selective lateral adjustment of the blade support panel 10 with respect to the guide rails 11. The panel adjustment knobs 12 may be threaded into the respective knob openings 15 and tightened against the blade support panel 10 to secure the blade support panel 10 with respect to the guide rails 11.

A blade support base 16 is provided on the blade support panel 10. As shown in FIG. 3, the blade support base 16 may include a pair of generally parallel, spaced-apart, triangular base side panels 17. A generally sloped base front panel 18, which may have a generally elongated, rectangular configuration, is attached to and extends between the base side panels 17. The base front panel 18 may be attached to the base side panels 17 using multiple panel fasteners 19 and/or other suitable fastening technique. Multiple blade attachment openings 20 may extend through the base front panel 18 in a selected pattern for purposes which will be hereinafter described.

In typical application, the assembly 1 may be used to sharpen carbide-tipped blade teeth 31 on a circular saw blade 30. Accordingly, the guide rails 11 are placed in the respective miter gauge slots 4 in the cutting surface 3 of the table saw 2, as shown in FIG. 2. The sharpening disk 6 is attached to the saw motor (not shown) of the table saw 2. The lateral position of the blade support base 16 with respect to the sharpening disk 6 may be selectively adjusted using the panel adjustment knobs 12, as was heretofore described. At least one stop 34 may be inserted and secured in one or both of the miter gauge slots 4 to limit the distance between the front edge of the blade support panel 10 and the edge of the sharpening disk 6.

As further shown in FIG. 2, the blade 30 having the blade teeth 31 which are to be sharpened is attached to the blade support base 16. Attachment of the blade 30 to the blade support base 16 may be accomplished by, for example, placing a blade support disk 24 against the sloped surface of the base front panel 18; aligning a central blade fastener opening 25 in the blade support disk 24 with a selected one of the blade attachment openings 20; and extending a threaded blade fastener 26 through a central blade opening 32 in the blade 30 and through the blade fastener opening 25 in the blade support disk 24, and threading the blade fastener 26 through the selected one of the blade attachment openings 20. As shown in FIG. 1, the lateral position of the blade support panel 10 with respect to the sharpening disk 6 may be adjusted using the panel adjustment knobs 12, and the proximity of the blade teeth 31 of the blade 30 with respect to the sharpening disk 6 may be adjusted by sliding the guide rails 11 in the respective miter gauge slots 4, to facilitate contact of the blade teeth 31 with the sharpening disk 6. Accordingly, by operation of the saw motor (not shown) of the table saw 2, the sharpening disk 6 may be individually and sequentially rotated against each blade tooth 31 to sharpen each blade tooth 31. Sequential advancement of the individual blade teeth 31 against the rotating sharpening disk 6 may be facilitated by manual rotation of the blade 30 with respect to the blade fastener 26. After the blade teeth 31 on the blade 30 are sharpened, the blade 30 may be removed from the blade support base 16 by unthreading of the blade fastener 26 from the blade attachment opening 20 (FIG. 2) and removal of the blade fastener 26 from the blade fastening opening 25 of the blade support disk 24 and the blade opening 32 of the blade 30.

While the preferred embodiments of the disclosure have been described above, it will be recognized and understood that various modifications can be made in the disclosure and the appended claims are intended to cover all such modifications which may fall within the spirit and scope of the disclosure.

What is claimed is:

1. A saw blade sharpening assembly, comprising:

a sharpening disk;

a blade support panel disposed generally adjacent to said sharpening disk; and a generally sloped blade support base carried by said blade support panel; wherein said blade support base comprises a pair of spaced apart base slide panels carried by said blade support panel and a generally sloped base front carried by said base side panels; and further comprising a plurality of blade attachment openings provided in said sloped base front panel.

2. The assembly of claim 1 further comprising a pair of generally elongated, parallel, spaced-apart guide rails carried by said blade support panel.

3. The assembly of claim 2 wherein said blade support panel is laterally adjustable with respect to said guide rails.

4. The assembly of claim 3 further comprising at least two panel adjustment slots provided in said blade support panel and at least two panel adjustment knobs extending through said at least two panel adjustment slots, respectively, and engaging said guide rails, respectively.

5. The assembly of claim 1 further comprising a blade support disk carried by said blade support base.

6. A saw blade sharpening assembly, comprising:

a table saw comprising:

a cutting surface;

a pair of generally elongated, parallel, spaced-apart miter gauge slots provided in said cutting surface;

a blade slot provided in said cutting surface between said miter gauge slots; and a sharpening disk extending through said blade slot;

a pair of generally elongated, parallel, spaced-apart guide rails inserted in said miter gauge slots, respectively;

a blade support panel carried by said guide rails and disposed generally adjacent to said sharpening disk; and a generally sloped blade support base carried by said blade support panel.

7. The assembly of claim 6 wherein said blade support panel is laterally adjustable with respect to said guide rails.

8. The assembly of claim 7 further comprising at least two panel adjustment slots provided in said blade support panel and at least two panel adjustment knobs extending through said at least two panel adjustment slots, respectively, and engaging said guide rails, respectively.

9. The assembly of claim 6 wherein said blade support base comprises a pair of spaced-apart base side panels carried by said blade support panel and a generally sloped base front panel carried by said base side panels.

10. The assembly of claim 9 further comprising a plurality of blade attachment openings provided in said base front panel.

11. The assembly of claim 10 further comprising a blade support disk attached to one of said plurality of blade attachment openings.

12. The assembly of claim 6 further comprising at least one stop provided in at least one of said guide rails and engaging said blade support panel.

* * * * *